United States Patent [19]

Meschi

[11] Patent Number: 4,964,511

[45] Date of Patent: Oct. 23, 1990

[54] PACKING CASE, PARTICULARLY FOR SHEET MATERIAL

[75] Inventor: Luciano Meschi, Livorno, Italy

[73] Assignee: Wully S.A., Panama City, Panama

[21] Appl. No.: 392,556

[22] Filed: Aug. 11, 1989

Related U.S. Application Data

[60] Division of Ser. No. 137,064, Feb. 22, 1988, Pat. No. 4,854,414, which is a continuation of Ser. No. 581,216, Feb. 22, 1984, abandoned, which is a continuation of Ser. No. 342,747, Feb. 26, 1982, abandoned.

[30] Foreign Application Priority Data

Jan. 26, 1981 [IT] Italy ..... 20590/81[U]

[51] Int. Cl.[5] ..... B65D 5/00

[52] U.S. Cl. ..... 206/449; 206/451; 229/122; 229/23 BT

[58] Field of Search ..... 206/449, 559, 451; 229/23 R, 23 BT, 122, 125.34

[56] References Cited

U.S. PATENT DOCUMENTS

| | | | |
|---|---|---|---|
| 448,813 | 3/1891 | Bowman | 229/23 R |
| 626,681 | 6/1899 | Etnier | 206/449 |
| 2,119,435 | 5/1938 | Hutchison | 229/23 R |
| 3,288,345 | 11/1966 | Dilot | 229/125.34 |
| 3,722,668 | 3/1973 | Carpenter | 229/122 X |
| 4,111,299 | 9/1978 | Taub | 206/215 |
| 4,217,984 | 8/1980 | Magnuson | 229/23 BT |

FOREIGN PATENT DOCUMENTS

| | | | |
|---|---|---|---|
| 3361 | of 1913 | United Kingdom | 229/23 R |

*Primary Examiner*—William I. Price

*Attorney, Agent, or Firm*—McAulay Fisher Nissen & Goldberg

[57] ABSTRACT

A packing case for sheet material consisting of a container having a base and walls that may be lowered into a coplanar relationship with the base and are kept together in a raised condition by a cover member, whereby the removal of the cover member causes the box to open and to give full accessibility to the contents of the package while providing a suitable container for shipment of the contents.

19 Claims, 5 Drawing Sheets

PACKING CASE, PARTICULARLY FOR SHEET MATERIAL

This is a division of application Ser. No. 07/137,064, filed Feb. 22, 1988, now U.S. Pat. No. 4,854,414 which is a continuation of application Ser. No. 581,216 filed Feb. 22, 1984, abandoned which is a continuation of application Ser. No. 342,747 filed Jan. 26, 1982, now abandoned.

BACKGROUND OF THE INVENTION

The present invention concerns a box that may be opened, useful in particular for sheet material and such that the opening of the box lip, for simple removal of a cover member permits complete accessibility to the whole contents of the box.

It is known that to package sheet material there are utilized cardboard box containers, having a bottom and an upper closing part that may be opened. However, when the packing is opened, that is by opening the upper closing part, in order to have access to the packing content, it will be necessary to break or gut the box sides, with remarkable waste of time and discomfort. In addition, by opening it in this way, the container can no longer be reutilized. In some instances, in addition to the above-mentioned problem there is also the fact that the content of the box or package is generally somewhat heavy (whenever, for instance, form packages are involved), and has to be fed as such to machines, for example accounting or computing center printing machines, copying machines, etc., whereby the content of the package (or its residues) must be quickly eliminated or emptied before "processing" the content.

OBJECTS AND SUMMARY OF THE INVENTION

The main purpose of the present invention is that of providing a box that may be opened to make the content readily accessible in its entirety.

Another object of the present invention is to provide a box that will be readily and integrally reutilizable for successive packing operations.

A further object of the present invention is to provide a box that may be opened and will be of simple structure and economical to manufacture.

These and other purposes are obtained by means of a box that may be opened, including a containing body and a cover member adapted to fit on the containing body mouth, characterized in that the walls of the containing body consist in at least four panels, independent of one another and united along one of their base sides to the common bottom of the box, whereby the panels are divided among themselves through slits corresponding to the corners of the box.

According to the preferred embodiment of the invention, the cover member is shaped to completely encompass the lateral surface of the box, and of a height that corresponds to the height of the box, so that on one side removal of the cover releases the box and permits pulling down of the lateral panels until they become substantially coplanar with the bottom; the box is thus reduced to a flat structure which can be easily extracted from the bottom of the packing content and reutilized as such for other further packagings.

In turn, the cover member is closed at its upper part an enclosure having edges that can be restrained among themselves, so that the cover member, once extracted from the box-type container, can also be substantially flattened along a plane passing through two opposed corners and reutilized.

While the above-mentioned embodiment serves the purpose of providing the box with sufficient mechanical resistance for the stacking of many packages for the handling by pallets it is possible to provide the cover member high enough that the lateral panels of the box are kept united.

In accordance with another embodiment, the closing member of the box consist of angle sections, slidably engaging the corners of the box being angle sections united with one another with diagonally placed cross members that may serve the purpose of keeping the contents of the box in place.

BRIEF DESCRIPTION OF THE DRAWING

These and other features, purposes and advantages of the present invention will more clearly appear from the following detailed description and attached accompanying drawings wherein.

DESCRIPTION OF THE BEST MODE

Figure 1:
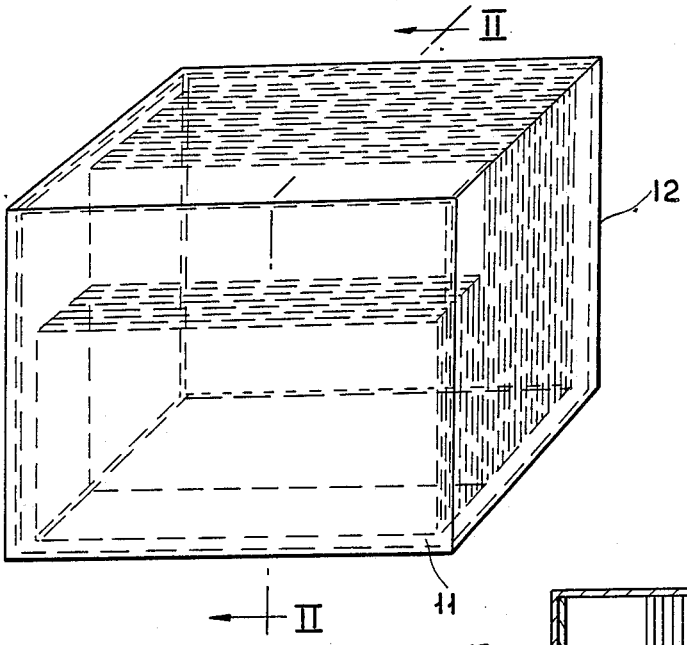
FIG. 1 is a perspective view of the box that can be opened in accordance with the invention wherein dotted lines show the inner configuration of the box and of its components.

Referring to FIGS. 1–4, there is shown a box containing form packages 10, united among themselves along opposed edges and adapted for feeding to fast printing machines of computing centers.

The box includes a box-type container 11 and an enclosure member 12.

The open-top container consists of a bottom panel 13 and four lateral panels 14 foldably united as a single piece along their base edges to one side of the bottom panel 13.

Figure 3:
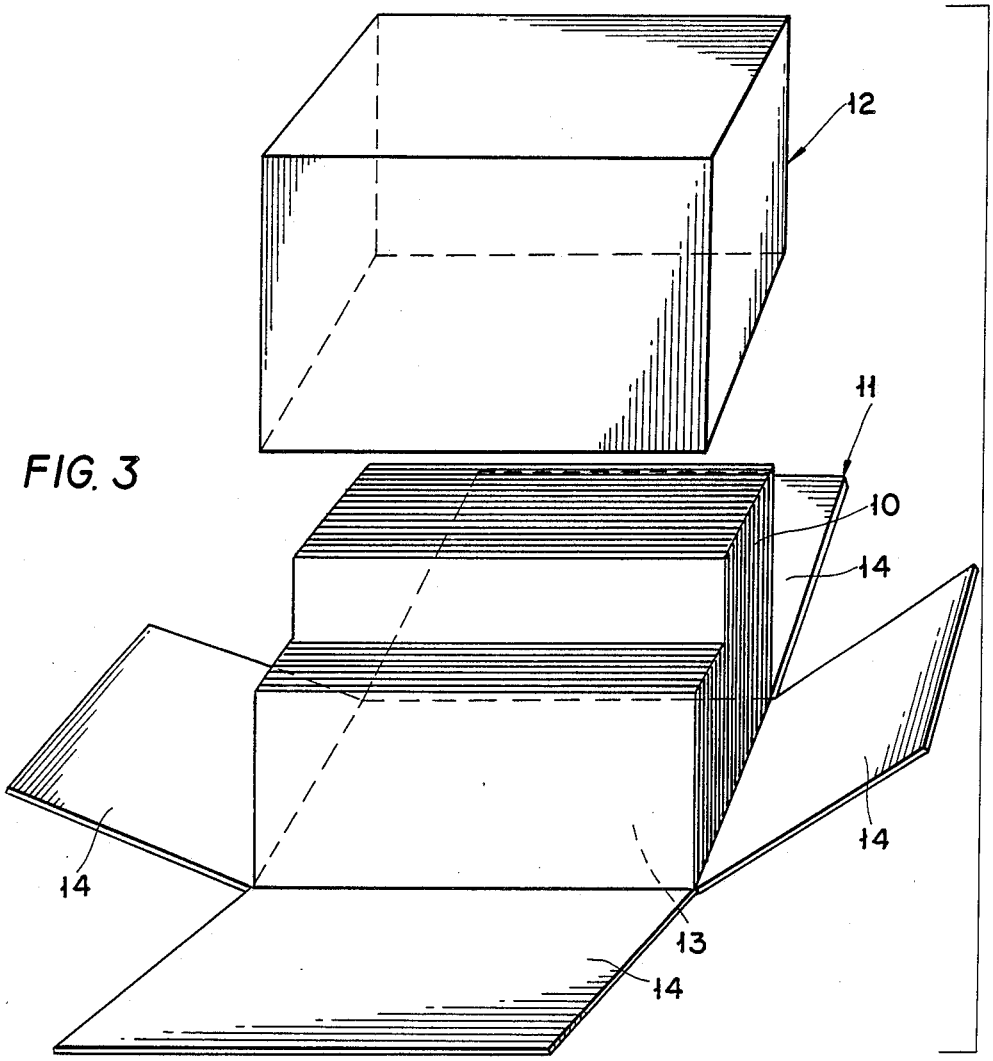
FIG. 3 is a perspective exploded view of the box of FIG. 1.

Between panels 14, corresponding to vertical corners of the container 11, slits are formed which permit panels 14 to fold, if not retained into vertical position in the FIG. 3 configuration.

On the container 11 is fitted an enclosure 12, including lateral panels 15 and a cover 16 formed with four folds 17, two opposite folds being engaged by means of a tongue 18 and slit 19.

As will be clearly seen from FIG. 1 and FIG. 3, the enclosure 12 is fitted on the box-type container 11, in order to retain the lateral panels 14 into vertical position. Enclosure 12 has preferably a height equal to that of the lateral panels 14, to prevent any accidental opening of the box container, but the complete package, even when entirely made with cardboard, particularly with corrugated packing board, is resistent to the vertical loads that are produced when many layers of packings will be packed for shipment.

It is evident that, when a form package has to be utilized, it will be sufficient to place the same into use position, extracting the cover member (which causes the almost complete pulling down of lateral panels 14 no longer retained into vertical position) and hence withdrawing the bottom panel and lateral panels from below the form package 10.

At the same time, by opening the folds 17 of the cover enclosure 16, the latter becomes substantially flat along the plane passing through two vertical opposed corners.

Figure 5:
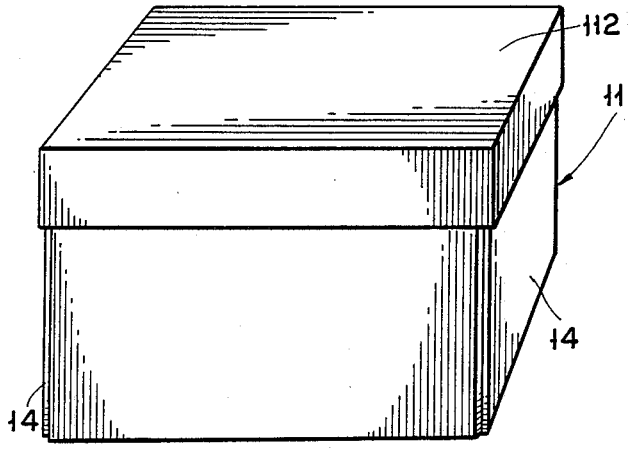
FIG. 5 is a perspective view of a box having a modified cover member.

In the modification illustrated in FIG. 5, the package is substantially unchanged, except for the cover member 112, more simply formed in box-type shape having a corner height sufficient to retain panels 14 into vertical position, but without extending itself for the whole height of container 11.

Figure 6:
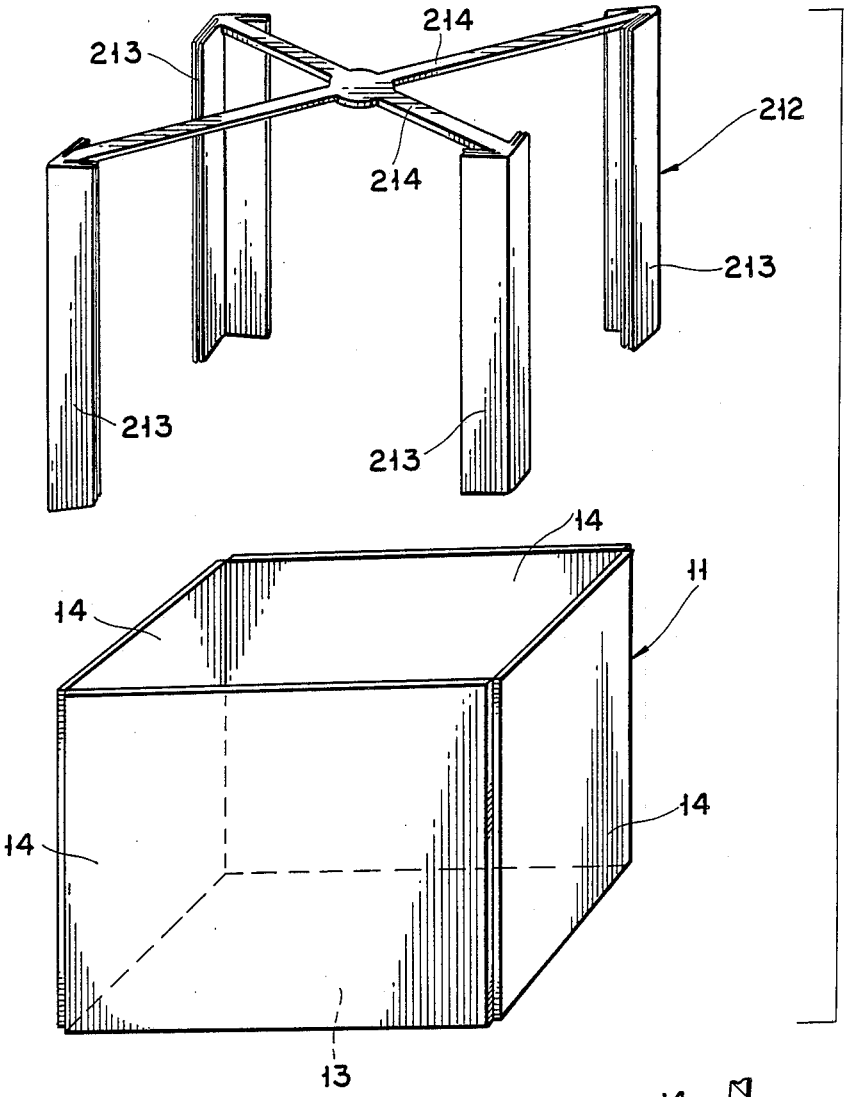
FIG. 6 is an exploded view of another embodiment of the cover member.
Figure 8:
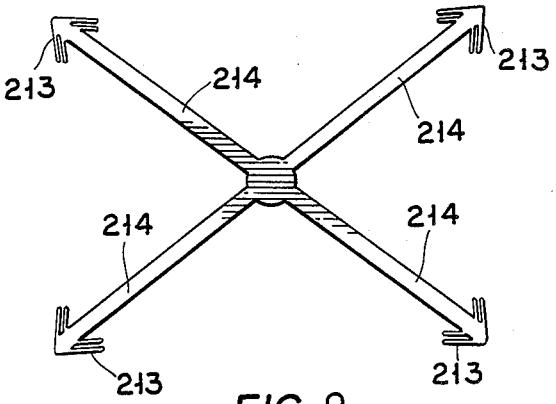
FIGS. 7 and 8 are detail views of the embodiment of FIG. 6.
Figure 7:
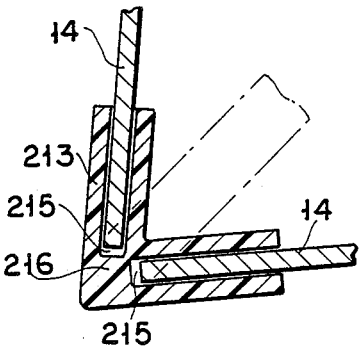
Figure 9:
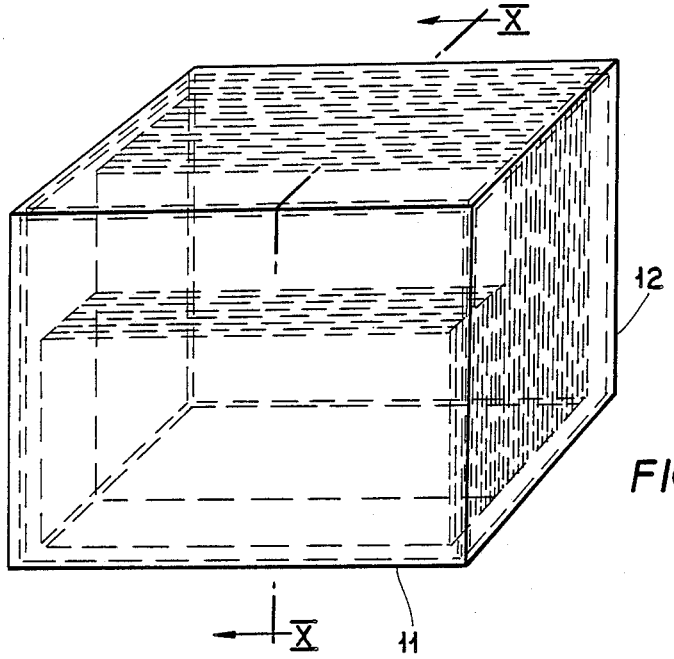
FIGS. 9 to 11 are views of a box with a container bottom having only three lateral flaps.
Figure 10:
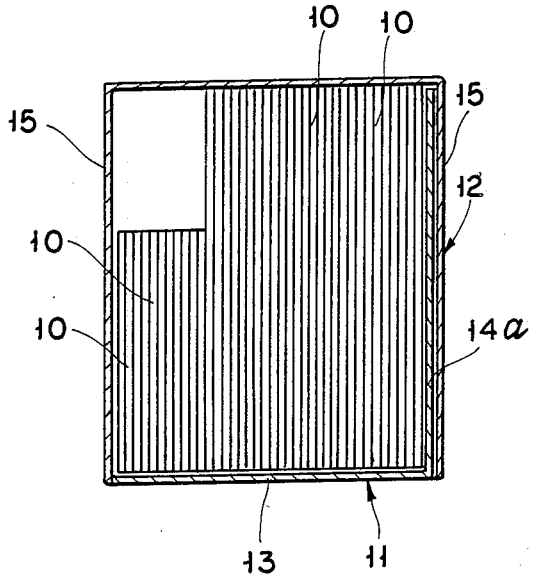
Figure 11:
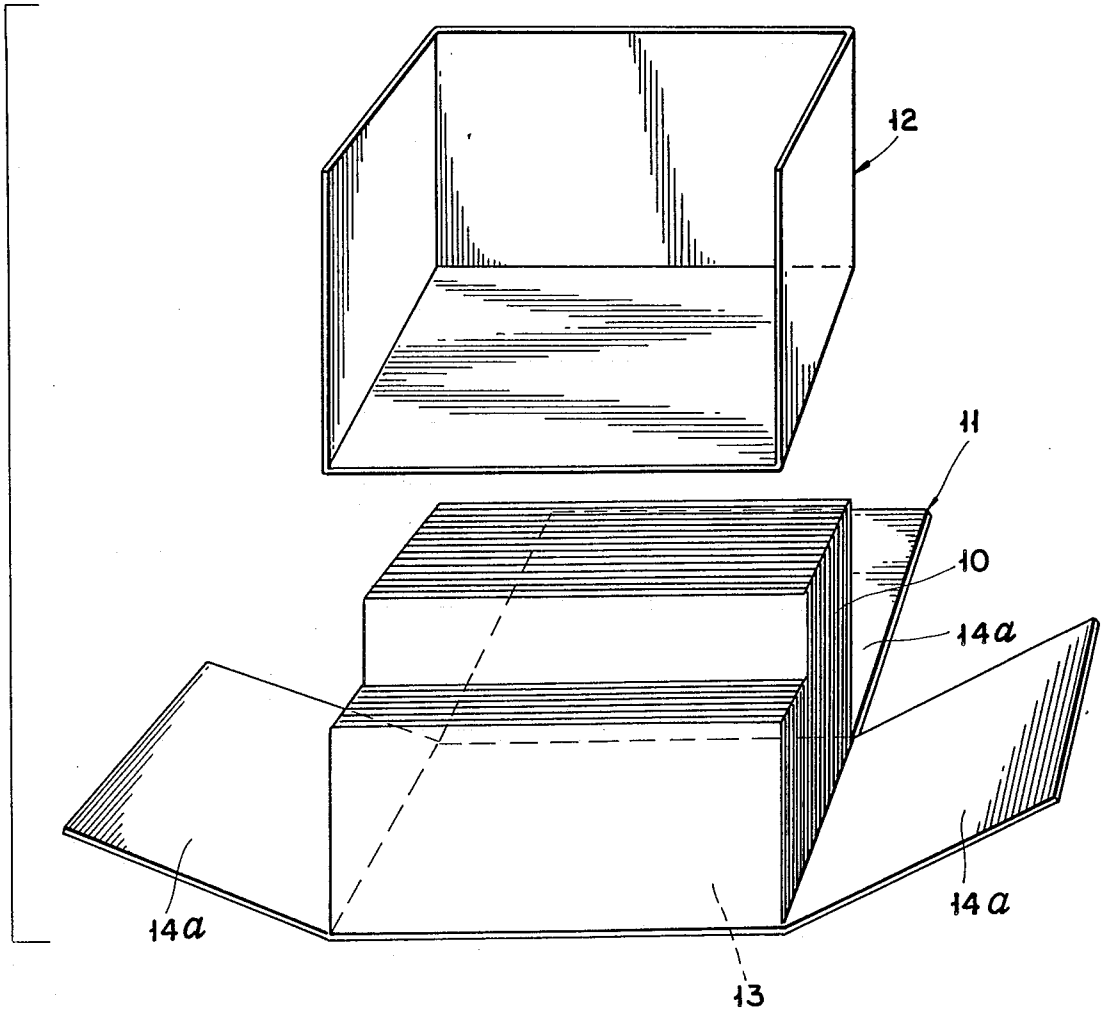

Referring finally to the embodiment of FIGS. 6, 7 and 8 in this instance too the container remains unchanged, including therefore the lateral panels 14 and the bottom panel 13, while the cover member is different and consists of four angle sections 213, joined among themselves through flexible diagonal members 214.

As will be clearly seen from FIG. 7, each angle section 213 forms, on both sides in respect to the confluence corner of two panels 14 the housing seats 215 that retain the same panels.

The angle sections 213 are preferably made from plastic material, such as semi-rigid PVC, and the seats 215 are preferably tapered from the corner 216 towards their mouth, in order to increase the retaining effect. Likewise the inner surfaces of the seats 215 may be roughened in order to improve the retaining effect.

While forming the packing, the sections 213 are inserted on the corners formed between adjacent pairs of panels 14, to be thereafter extracted when the package is opened. It is clear that the cross braces 214 do not serve any important purpose, but provide a greater usefulness to the closure and packing function provided by the sections 213.

It is to be pointed out that with the package of the present invention either the bottom and lateral panels of the container body, or the cover member, are preferably made with cardboard, it being understood that it is possible to use other materials. In accordance with a modified construction of the embodiment shown in the figures from 1 to 3, in order to facilitate the withdrawal of the container 11, once the cover 12 has been carried off, at least one of the lateral panels 14 is omitted, in which case on the corresponding sides of the package the form or sheet package will be separated from the outside only by the lateral panel 15 of the parallelepipedal cover 12.

Figure 2:
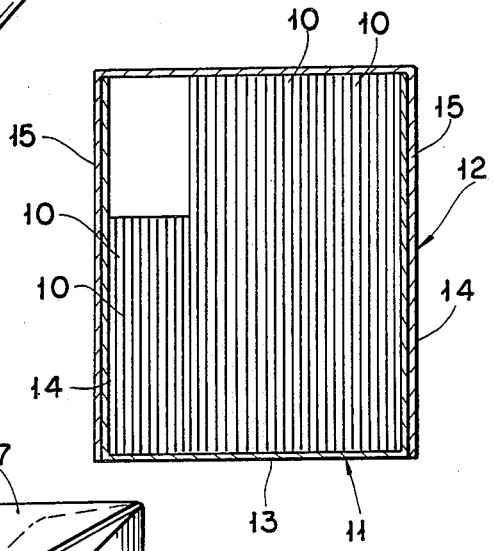
FIG. 2 is a cross sectional view taken along the plane II—II of FIG. 1.
Figure 4:
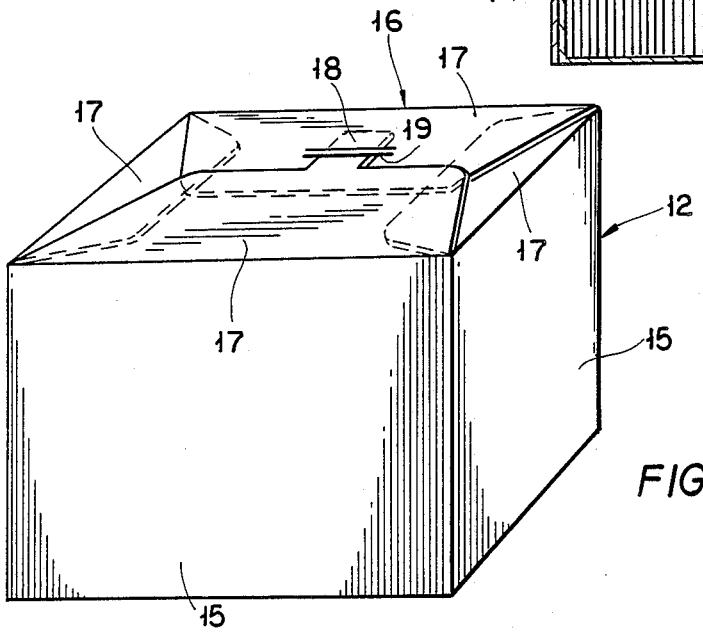
FIG. 4 is a perspective view of the cover member for the box of FIG. 1.

As is evident from the drawings, the individual sheets are joined to each other in a conventional manner to form a single connected sheet prior to their being placed into the container having at least three lateral panels. These sheets, as best seen in FIGS. 1, 2 and 3, are folded over in an overlapping relationship to form a package of sheets and to permit withdrawal of the topmost sheet when the container is opened.

What is claimed is:

1. A containerized storing, shipping and dispensing apparatus for containing a heavy package of paper sheets formed to each other to form a single connected sheet which is folded when placed onto the containerized packaging apparatus for shipping and storage in a closed condition and for storage and dispensing in an opened condition to provide complete accessibility to the whole contents of the containerized packaging apparatus and which enables removal of either a single sheet of the connected sheets or the entire package of sheets, consisting essentially of:

a first member consisting of a container member including a bottom panel and solely three lateral panels, each of said three lateral panels being joined to said bottom panel and being pivotal along an edge thereof, and being foldable relative thereto so that said three lateral panels can be pulled down until they are in substantially coplanar position with said bottom to provide complete accessibility to the sheets and movable out of said coplanar relationship with said bottom to a position substantially orthogonal thereto with paper sheets positioned on top of said bottom with said lateral panels adjacent to sides of the paper sheet to form a container with an open front and an open top commensurate in scope with one length dimension of the paper sheets;

said panels forming angularly related sidewalls for said container when in an upstanding position to provide a box-type packing which renders the contents thereof readily accessible and dispensable; and said pivotally joined panels being pivotal relative to said bottom to open themselves as a fold and moved into said substantially coplanar position; and a second member separate from said first member, comprising:

a parallelepipedal closure member having a top panel and solely four depending side walls depending therefrom, said top panel along all of its edges being fixed to said sidewalls and fitting over said three lateral panels of said container to encompass the whole lateral surface of said panels completely to close said open front and said open top to prevent dispensing of the single sheet or package of sheets and maintain said sidewalls thereof in an upright position to prevent accidental opening thereof; and said sidewalls of said closure member being of sufficient height to fit substantially entirely over said side panels with one of said sidewalls of said closure member covering said open front to provide rigidity in containerized shipping.

2. The containerized storing, shipping and dispensing apparatus of claim 1, wherein:

said package consists solely of said first and said second members;

said second member forming a top closure member and including four opposite top closing panels foldable on one another, two of said panels being larger than two others of said panels; and one of said larger top panels of said top closure having a projecting tongue and the panel opposite to said one top panels having a slit adapted to receive said tongue to close said two panels over the other two top panels, said opposite top panel being larger than said two others of said panels.

3. The containerized storing, shipping and dispensing apparatus of claim 2, wherein said three lateral panels form slits between each pair of two adjacent side panels to facilitate opening thereof, and at least one of said container and said closure member being formed of a load-bearing material composed of a semi-rigid material such as cardboard so that the package is resistant to vertical loads when stacked for shipment.

4. The containerized storing, shipping and dispensing apparatus as claimed in claim 2, wherein only two of said panels are contiguous to a third of said panels.

5. The containerized storing, shipping and dispensing apparatus as claimed in claim 2, wherein each of said three lateral panels are independent of each other and with two sides parallel to each other and orthogonal to a third side when folded to form said container;

said parallelepipedal closure member upon removal from said three lateral panels along all of its edges being fixed to said four depending sidewalls and fitting over said three lateral panels of said container to encompass the whole lateral surface of said panels completely to close the open portions thereof and maintain said sidewalls thereof in an upright position to prevent accidental opening thereof and removal of either the single sheet or the entire package of sheets; and said parallelepipedal closure upon removal from said three lateral panels releases the box permitting pulling down of said three lateral panels until they become substantially coplanar with said common bottom and said lateral panels forming therewith a flat structure having coplanar extensions easily extractable from said whole contents of said package to remove the containerized packaging article free of gutting the containerized packaging article.

6. The containerized storing, shipping and dispensing apparatus as claimed in claim 5, wherein said four depending side walls fit completely over said three lateral panels.

7. The containerized storing, shipping and dispensing apparatus of claim 5, wherein said angularly related sidewalls of said first member and said depending sidewalls of said second member forming said closure member have equal corner heights, said lateral panels each form with an adjacent panel slits therebetween to facilitate opening thereof, and at least one of said container and said closure members being formed of load-bearing material composed of a semi-rigid material so that the containerized packaging article is resistant to vertical loads when stacked for shipment.

8. The containerized storing, shipping and dispensing apparatus of claim 6, wherein said angularly related sidewalls of said first member and said depending sidewalls of said second member forming said closure member have equal corner heights, said lateral panels each form with an adjacent panel slits therebetween to facilitate opening thereof, and at least one of said container and said closure members being formed of load-bearing material composed of a semi-rigid material such as cardboard so that the containerized packaging article is resistant to vertical loads when stacked for shipment.

9. The containerized storing, shipping and dispensing apparatus of claim 1, wherein said three lateral panels form slits between each pair of two adjacent side panels to facilitate opening thereof, and at least one of said container and said closure member being formed of load-bearing material composed of a semi-rigid material such as cardboard so that the package is resistant to vertical loads when stacked for shipment.

10. The containerized storing, shipping and dispensing apparatus as claimed in claim 9, wherein only two of said panels are contiguous to a third of said panels.

11. The containerized storing, shipping and dispensing apparatus as claimed in claim 1, wherein only two of said panels are contiguous to a third of said panels.

12. The containerized storing, shipping and dispensing apparatus as claimed in claim 1, wherein:

each of said three lateral panels are independent of each other and with two sides parallel to each other and orthogonal to a third side when folded to form said container;

said parallelepipedal closure member upon removal from said three lateral panels along all of its edges being fixed to said four depending sidewalls and fitting over said three lateral panels of said container to encompass the whole lateral surface of said panels completely to close the open portions thereof and maintain said sidewalls thereof in an upright position to prevent accidental opening thereof and removal of either the single sheet or the entire package of sheets; and said parallelepipedal closure upon removal from said three lateral panels releases the box permitting pulling down of said three lateral panels until they become substantially coplanar with said common bottom and said lateral panels forming therewith a flat structure having coplanar extensions easily extractable from said whole contents of said package to remove the containerized packaging article free of gutting the containerized packaging article, thereby to permit the containerized package to be reused.

13. The containerized storing, shipping and dispensing apparatus as claimed in claim 12, wherein said four depending side walls fit completely over said three lateral panels.

14. The containerized storing, shipping and dispensing apparatus of claim 12, wherein said angularly related sidewalls of said first member and said depending sidewalls of said second member forming said closure member having equal corner height, said laterals panels each form with an adjacent panel slits therebetween to facilitate opening thereof, and at least one of said container and said closure members being formed of load-bearing material composed of a semi-rigid material such as cardboard so that the containerized packaging article is resistant to vertical loads when stacked for shipment.

15. The containerized storing, shipping and dispensing apparatus of claim 13, wherein said angularly related sidewalls of said first member and said depending sidewalls of said second member forming said closure member having equal corner height, said lateral panels each form with an adjacent panel slits therebetween to facilitate opening thereof, and at least one of said container and said closure members being formed of load-bearing material composed of a semi-rigid material such as cardboard so that the containerized packaging article is resistant to vertical loads when stacked for shipment.

16. A packaging article which when opened provides complete accessibility to the whole contents of the package and which when closed is usable as a storage and shipping container, said packaging article comprising:

an open top container including a bottom and solely three lateral panels, each of said three lateral panels having a base, and only said base of said three lateral panels being joined to said bottom and each said base forming an edge with said bottom and being pivotal along said edge thereof, and being foldable relative thereto from two orthogonal directions;

said panels forming solely three angularly related sidewalls for said container when in an upstanding position to provide a box-type packing having an open top and an open side to form solely an open top and an open-sided-container providing an open front;

said angularly related sidewalls when in the upstanding position not completely closing the container and forming open portions thereof, one of the top portions being the open top and the other of the open portions being the open front, the three pivotally joined panels each individually being pivotal relative to said bottom to open themselves as a fold;

said foldable lateral panels being pivotal relative to said bottom to facilitate placement of a plurality of individual sheets joined to each other to form a single connected sheet into said open top container, the plurality of individual sheets being folded in an overlapping relationship to form a package of sheets;

a parallelepipedal closure member separate from said open top container having a top and solely depending sidewalls depending therefrom and fitting over said three lateral panels of said container and covering the open side to close the open portions thereof and maintain said sidewalls thereof in an upright position, said sidewalls of said closure member being of sufficient height to fit substantially entirely over said panels and the base of each of the sidewalls extending to said bottom to enclose said three sidewalls, the open top and the open front; and said three lateral panels being pivoted along a respective edge thereof to an upstanding position against the package of sheets in said open top container while having an opening between two selected of said three lateral panels equal to a length or a width dimension of said sheets; and then said closure member is placed over the open top container with the package of sheets therein to hold said three lateral panels against the package of sheets for shipment and/or storage of the sheets in said open top container so as to cooperate with said lateral panels to impart rigidity to the lateral panels and with one of said sidewalls of said closure member covering said open front to prevent access to the sheets in the open top container through either the open top or the open front thereby to prevent removal of the sheets when the package is closed; and said closure member being adapted to be removed to expose said three lateral panels and said open front and release the three panels from their vertical position, so that said three lateral panels can be pulled down until they are substantially coplanar with said bottom to provide complete accessibility to the sheets.

17. The containerized storing, shipping and dispensing apparatus of claim 16, wherein said angularly related sidewalls and said depending sidewalls of said closure member each have equal corner heights, said three lateral panels form with an adjacent panel slits therebetween to facilitate opening thereof, and at least one of said container and said closure member being formed of load-bearing material composed of a semi-rigid material such as cardboard so that the containerized packaging article is resistant to vertical loads when stacked for shipment.

18. The containerized storing, shipping and dispensing apparatus of claim 16, wherein said three lateral panels form slits therebetween to facilitate opening thereof, and at least one of said container and said closure member is formed of load-bearing material composed of a semi-rigid material such as cardboard so that the containerized package is resistant to vertical loads when stacked for shipment.

19. A package containing a heavy package of paper sheets formed to each other to form a single connected sheet which is folded when placed into the package and which when opened provides complete accessibility to the whole contents of the package and which permits removal of either a single sheet of the connected sheets or the entire package of sheets, comprising:

an open top container including a bottom and three lateral panels, each of said three lateral panels being joined to said bottom and pivotal along an edge thereof, and being foldable relative thereto to form a container with an open front and an open top each having a length or width open dimension substantially equal to a length or width dimension of the paper;

said panels forming angularly related sidewalls for said container when in an upstanding position to provide a box-type packing which renders the contents thereof readily accessible;

said pivotally joined panels being pivotal relative to said bottom to open themselves as a fold such that said three lateral panels can be pulled down until they are substantially coplanar with said bottom to provide complete accessibility to the sheets; and a separate parallelepipedal closure member separate from said container having a top and solely four depending sidewalls depending therefrom, said top along all of its edges being fixed to said sidewalls and fitting over said three lateral panels of said container to encompass the whole lateral surface of said panels completely to close the open portions thereof with one of said sidewalls of said closure member covering said open front and maintain said sidewalls thereof in an upright position to prevent accidental opening thereof;

said sidewalls of said closure member being of sufficient height to fit substantially entirely over said panels to prevent withdrawal of said sheets through said open front.

* * * * *